US007303388B2

(12) United States Patent
Joshi et al.

(10) Patent No.: US 7,303,388 B2
(45) Date of Patent: Dec. 4, 2007

(54) STAGED COMBUSTION SYSTEM WITH IGNITION-ASSISTED FUEL LANCES

(75) Inventors: Mahendra Ladharam Joshi, Allentown, PA (US); Aleksandar Georgi Slavejkov, Allentown, PA (US); Xianming Jimmy Li, Orefield, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 359 days.

(21) Appl. No.: 10/883,349

(22) Filed: Jul. 1, 2004

(65) Prior Publication Data

US 2006/0000395 A1 Jan. 5, 2006

(51) Int. Cl.
*F23D 5/00* (2006.01)

(52) U.S. Cl. ..... 431/10; 431/181; 431/187; 431/350; 431/353; 239/601

(58) Field of Classification Search ..... 431/285, 431/10, 181, 187, 350, 353, 354, 355, 349; 239/568, 556, 432, 433, 434.5, 524, 567, 239/590.3, 423, 553.5, 590.5
See application file for complete search history.

(56) References Cited

U.S. PATENT DOCUMENTS 1,113,894 A * 10/1914 Fitzpatrick ..... 239/402.5
1,753,962 A * 4/1930 Lonergan ..... 431/180
1,809,658 A * 6/1931 Wendt ..... 239/434.5
1,952,919 A * 3/1934 Haskell, Jr. ..... 431/349
2,149,980 A 3/1939 Paret, Jr.
2,573,144 A * 10/1951 Jaye ..... 239/566
2,638,976 A * 5/1953 Vixler ..... 239/419.5
2,959,361 A * 11/1960 Stanislaw ..... 239/568
3,288,377 A * 11/1966 Van De Roer ..... 239/433
3,319,098 A * 5/1967 Hartman ..... 310/90
3,820,945 A * 6/1974 Vignes ..... 431/349
4,472,136 A * 9/1984 Lefebvre ..... 431/186
4,548,032 A * 10/1985 Sepulveda et al. ..... 60/776
4,927,357 A 5/1990 Yap
5,069,616 A 12/1991 Larsson
5,240,404 A 8/1993 Hemsath et al.
5,321,948 A 6/1994 Leonard
5,460,515 A 10/1995 Harbeck et al.
5,954,495 A 9/1999 Knopfel et al.
5,975,886 A 11/1999 Philippe
5,992,763 A * 11/1999 Smith et al. ..... 239/428.5

(Continued)

FOREIGN PATENT DOCUMENTS

DE 3838635 A 5/1990

(Continued)

OTHER PUBLICATIONS

Pending U.S. Appl. No. 10/353,683, Joshi, et al. "Slotted Injection Nozzle and Low NOx Burner Assembly", Patent Appln. 06332 USA.

*Primary Examiner*—Carl D. Price
(74) *Attorney, Agent, or Firm*—Bryan C. Hoke, Jr.

(57) ABSTRACT

Combustion system comprising a furnace having a thermal load and a combustion atmosphere disposed therein; one or more fuel lances adapted to inject fuel into the combustion atmosphere; and one or more igniters associated with the one or more fuel lances and adapted to ignite the fuel injected by the one or more fuel lances into the combustion atmosphere.

4 Claims, 10 Drawing Sheets

U.S. PATENT DOCUMENTS

| | | | | |
|---|---|---|---|---|
| 6,036,481 | A | 3/2000 | Legutko et al. | |
| 6,082,994 | A * | 7/2000 | Grandveau et al. | 431/349 |
| 6,186,775 | B1 | 2/2001 | Jansohn et al. | |
| 6,210,152 | B1 | 4/2001 | Haffner et al. | |
| 6,250,063 | B1 | 6/2001 | Davis, Jr. et al. | |
| 6,331,107 | B1 | 12/2001 | Philippe | |
| 6,381,947 | B2 | 5/2002 | Emmons | |
| 6,558,154 | B2 | 5/2003 | Eroglu et al. | |
| 6,565,361 | B2 | 5/2003 | Jones et al. | |
| 6,607,376 | B2 | 8/2003 | Poe | |
| 6,609,376 | B2 | 8/2003 | Rokke | |
| 6,866,503 | B2 * | 3/2005 | Ladharam | 431/10 |
| 2002/0177093 | A1 | 11/2002 | Paschereit et al. | |
| 2003/0074885 | A1 | 4/2003 | Rokke | |
| 2003/0106321 | A1 | 6/2003 | Von Der Bank | |
| 2003/0148236 | A1 | 8/2003 | Joshi et al. | |
| 2003/0152880 | A1 | 8/2003 | Eroglu et al. | |
| 2003/0175638 | A1 | 9/2003 | Stephens | |
| 2003/0175642 | A1 | 9/2003 | Stephens et al. | |
| 2003/0175643 | A1 | 9/2003 | Stephens et al. | |
| 2003/0175644 | A1 | 9/2003 | Spicer | |
| 2003/0175645 | A1 | 9/2003 | Stephens | |
| 2003/0175646 | A1 | 9/2003 | Stephens et al. | |
| 2003/0223926 | A1 | 12/2003 | Edlund et al. | |
| 2004/0018461 | A1 | 1/2004 | Stephens et al. | |
| 2004/0018462 | A1 | 1/2004 | Stephens et al. | |

FOREIGN PATENT DOCUMENTS

| | | | |
|---|---|---|---|
| EP | 571704 | B1 | 12/1996 |
| EP | 0 754 912 | A2 | 1/1997 |
| EP | 816755 | A2 | 1/1998 |
| EP | 1 205 710 | A1 | 5/2002 |
| EP | 1 243 565 | A2 | 9/2002 |
| EP | 1 443 271 | A1 | 8/2004 |
| FR | 2 317 592 | A | 2/1977 |
| GB | 2 020 001 | * | 11/1979 |
| WO | WO 99/04196 | A | 1/1999 |

* cited by examiner

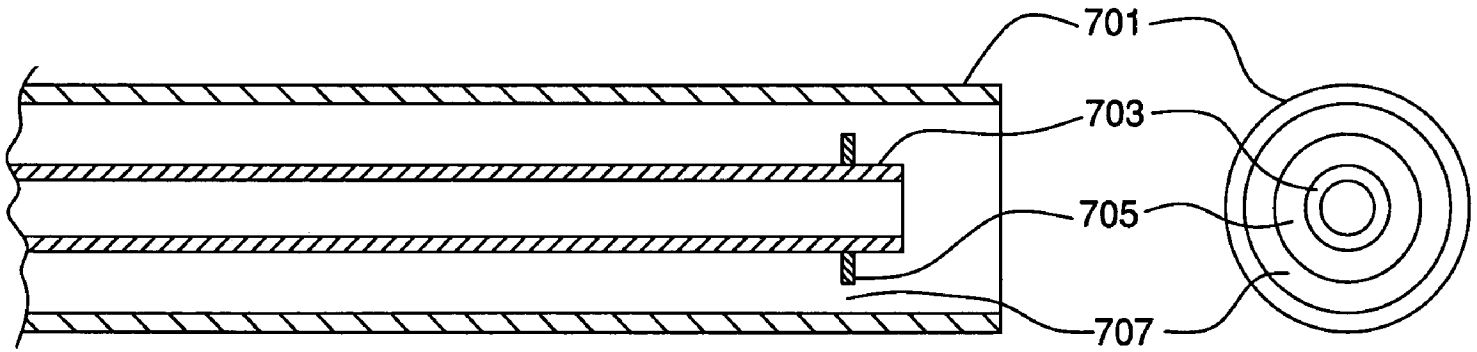
FIG. 7B
FIG. 7A
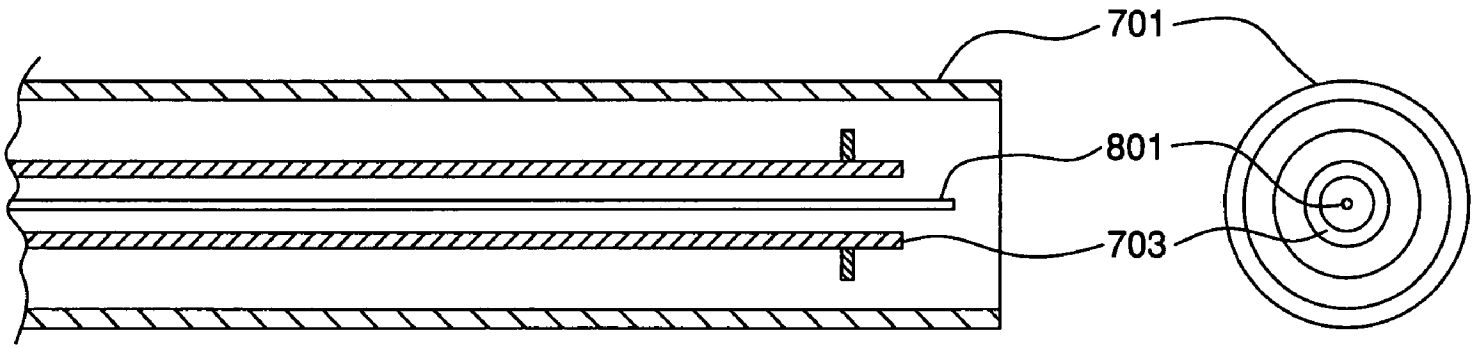
FIG. 8B
FIG. 8A

STAGED COMBUSTION SYSTEM WITH IGNITION-ASSISTED FUEL LANCES

BACKGROUND OF THE INVENTION

Staged combustion systems are used to improve combustion by introducing successive portions of fuel into the combustion process to allow the oxidant and fuel to react in multiple zones or stages. This produces lower peak flame temperatures and other favorable combustion conditions that reduce the generation of nitrogen oxides ($NO_x$). A wide variety of staged combustion methods are known and used in combustion applications including process heaters, furnaces, steam boilers, gas turbine combustors, coal-fired power generation units, and many other combustion systems in the metallurgical and chemical process industries.

The combustion of a gaseous fuel with oxygen in an oxygen-containing gas such as air occurs when a fuel-oxygen-inert gas mixture having a composition in the combustible region reaches its autoignition temperature or is ignited by a separate ignition source. When the combustion occurs in a three-dimensional process space such as a furnace, the degree of mixing is another important variable in the combustion process. The degree of mixing in the furnace, especially in the regions near the burners, affects localized gas compositions and temperatures, and therefore is an important factor in operating stability.

In combustion processes, particularly in staged combustion processes for $NO_x$ reduction, it is important to have good flame stability and proper location of the flame front relative to the points at which staging fuel is introduced into the combustion space. In conventional combustion systems, flame stability may be maintained by the use of fuel injection devices and internal recirculation patterns to improve the contact of the fuel stream with the combustion atmosphere and to provide the ignition energy required to sustain flame stability. Improper control of flame stability and flame location in staged combustion systems, particularly during cold startup, process upsets, or turndown conditions, may result in undesirable combustion performance, higher $NO_x$ emissions, and/or unburned fuel. This latter condition could lead to substantial pockets of fuel in the furnace and the possibility of an uncontrolled energy release.

There is a need in staged combustion processes for improved flame stability and complete fuel combustion, particularly during unsteady-state operating periods such as cold startup, process upsets, or process turndown conditions. Improved staged combustion systems to meet these needs are disclosed by embodiments of the present invention described below and defined by the claims that follow.

BRIEF SUMMARY OF THE INVENTION

An embodiment of the invention relates to a combustion system comprising a furnace having a thermal load and a combustion atmosphere disposed therein; one or more fuel lances adapted to inject fuel into the combustion atmosphere; and one or more igniters associated with the one or more fuel lances and adapted to ignite the fuel injected by the one or more fuel lances into the combustion atmosphere. The one or more igniters may be selected from the group consisting of intermittent spark igniters, continuous spark igniters, DC arc plasmas, microwave plasmas, RF plasmas, high energy laser beams, and oxidant-fuel pilot burners. In this embodiment, at least one of the igniters may be disposed adjacent to a fuel lance and may be adapted to ignite fuel discharged therefrom. Alternatively, at least one of the igniters may be integrated into a fuel lance and adapted to ignite fuel discharged therefrom. The number of fuel lances may be equal to or less than the number of igniters.

Another embodiment relates to a fuel lance comprising a nozzle body having an inlet face, an outlet face, and an inlet flow axis passing through the inlet and outlet faces, and two or more slots extending through the nozzle body from the inlet face to the outlet face, each slot having a slot axis, wherein the slot axis of at least one of the slots is not parallel to the inlet flow axis of the nozzle body, and wherein the slots are adapted to discharge a fuel at the outlet face of the nozzle body; and an igniter associated with the nozzle body and adapted to ignite the fuel discharged at the outlet face of the nozzle body. The igniter may be disposed adjacent the outlet face of the nozzle body; alternatively, the igniter may be integrated into the nozzle body and passes through the outlet face of the nozzle body.

An alternative embodiment pertains to a fuel lance comprising a nozzle body having an inlet face, an outlet face, and an inlet flow axis passing through the inlet and outlet faces, two or more slots extending through the nozzle body from the inlet face to the outlet face, each slot having a slot axis and a slot center plane, wherein none of the slots intersect other slots and all of the slots are in fluid flow communication with a common fuel supply conduit; and an igniter associated with the nozzle body and adapted to ignite the fuel discharged at the outlet face of the nozzle body. The igniter may be disposed adjacent the outlet face of the nozzle body; alternatively, the igniter may be integrated into the nozzle body and passes through the outlet face of the nozzle body.

In another alternative embodiment, the fuel lance may comprise a nozzle body having an inlet face, an outlet face, and an inlet flow axis passing through the inlet and outlet faces and two or more slots extending through the nozzle body from the inlet face to the outlet face, each slot having a slot axis and a slot center plane, wherein a first slot of the two or more slots is intersected by each of the other slots and the slot center plane of at least one of the slots intersects the inlet flow axis of the nozzle body; and an igniter associated with the nozzle body and adapted to ignite the fuel discharged at the outlet face of the nozzle body. The igniter may be disposed adjacent the outlet face of the nozzle body; alternatively, the igniter may be integrated into the nozzle body and passes through the outlet face of the nozzle body.

A related embodiment of the invention includes a combustion system comprising a furnace comprising an enclosure and a thermal load disposed within the enclosure; one or more oxidant gas injectors mounted in the enclosure and adapted to introduce an oxidant gas into the furnace; one or more fuel lances mounted in the enclosure and spaced apart from the one or more oxidant gas injectors, wherein the one or more fuel lances are adapted to inject fuel into the furnace; and one or more igniters associated with the one or more fuel lances and adapted to ignite the fuel injected by the fuel lances.

In this embodiment, the one or more igniters may be selected from the group consisting of intermittent spark igniters, continuous spark igniters, DC arc plasmas, microwave plasmas, RF plasmas, high energy laser beams, and oxidant-fuel pilot burners. At least one of the igniters may be adjacent to a fuel lance and adapted to ignite fuel discharged therefrom. Alternatively, at least one of the igniters may be integrated into a fuel lance and adapted to ignite fuel discharged therefrom. The number of fuel lances may be equal to or less than the number of igniters. The distance between the periphery of one of the one or more oxidant gas injectors and the periphery of an adjacent fuel lance may be in the range of 2 to 50 inches.

Another related embodiment of the invention pertains to a combustion system comprising a furnace having a thermal load and a combustion atmosphere disposed therein; a central burner having an axis, a primary fuel inlet, an oxidant gas inlet, and a combustion gas outlet adapted to introduce the combustion gas into the furnace; one or more staging fuel lances disposed radially from the axis of the central burner and adapted to inject a staging fuel into the combustion atmosphere in the furnace; and one or more igniters associated with the one or more staging fuel lances and adapted to ignite the staging fuel injected therefrom.

In this embodiment, the one or more igniters may be selected from the group consisting of intermittent spark igniters, continuous spark igniters, DC arc plasmas, microwave plasmas, RF plasmas, high energy laser beams, and oxidant-fuel pilot burners. At least one of the igniters may be adjacent to a fuel lance and adapted to ignite fuel discharged therefrom. Alternatively, at least one of the igniters may be integrated into a fuel lance and adapted to ignite fuel discharged therefrom. The number of fuel lances may be equal to or less than the number of igniters.

The system of this embodiment may further comprise main fuel piping adapted to provide the primary fuel to the central burner and staging fuel piping adapted to provide the staging fuel to the one or more staging fuel lances. The primary fuel to the central burner and the staging fuel to the one or more staging fuel lances are identical in composition; alternatively, the primary fuel to the central burner and the staging fuel to the one or more staging fuel lances are different in composition. The one or more staging fuel lances may be disposed outside of the central burner and may be disposed radially from the axis of the central burner.

An alternative related embodiment of the invention includes a combustion process comprising:

(a) providing a combustion system comprising:
  (1) a furnace having a thermal load and a combustion atmosphere disposed therein;
  (2) a central burner having an axis, a primary fuel inlet, an oxidant gas inlet, and a combustion gas outlet adapted to introduce the combustion gas into the furnace;
  (3) one or more staging fuel lances disposed radially from the axis of the central burner and adapted to inject a staging fuel into the combustion atmosphere in the furnace; and
  (4) one or more igniters associated with the one or more staging fuel lances and adapted to ignite the staging fuel discharged therefrom.
(b) introducing the oxidant gas through the oxidant gas inlet and injecting fuel through the one or more fuel lances into the combustion atmosphere in the furnace; and
(c) operating the one or more igniters and igniting the fuel from the fuel lances to cause combustion of the fuel with oxygen in the combustion atmosphere.

In this embodiment, the fuel may be selected from natural gas, refinery offgas, associated gas from crude oil production, and combustible process waste gas. A plurality of fuel lances may be used and fuels of different compositions may be used in the plurality of fuel lances.

Another alternative related embodiment of the invention pertains to a combustion process comprising:

(a) providing burner assembly including:
  (1) a central flame holder having inlet means for an oxidant gas, inlet means for a primary fuel, a combustion region for combusting the oxidant gas and the primary fuel, and an outlet for discharging a primary effluent from the flame holder; and
  (2) a plurality of secondary fuel injector nozzles surrounding the outlet of the central flame holder, wherein each secondary fuel injector nozzle comprises:
    (2a) a nozzle body having an inlet face, an outlet face, and an inlet flow axis passing through the inlet and outlet faces; and
    (2b) one or more slots extending through the nozzle body from the inlet face to the outlet face, each slot having a slot axis and a slot center plane;
  (3) one or more igniters associated with the plurality of secondary fuel injector nozzles;
(b) introducing the primary fuel and the oxidant gas into the central flame holder, combusting the primary fuel with a portion of the oxidant gas in the combustion region of the flame holder, and discharging a primary effluent containing combustion products and excess oxidant gas from the outlet of the flame holder; and
(c) injecting the secondary fuel through the secondary fuel injector nozzles into the primary effluent from the outlet of the flame holder; and
(d) operating the one or more igniters and igniting the fuel from the secondary fuel injector nozzles to cause combustion of the fuel with the excess oxidant in the combustion products.

In this embodiment, the primary fuel and the secondary fuel may be gases having different compositions. The primary fuel may be natural gas or refinery offgas and the secondary fuel may comprise hydrogen, methane, carbon monoxide, and carbon dioxide obtained from a pressure swing adsorption system. Alternatively, the primary fuel and the secondary fuel may be gases having the same compositions.

A different embodiment of the invention relates to a combustion process comprising:

(a) providing a combustion system including
  (1) a furnace having an enclosure with a thermal load and a combustion atmosphere disposed within the enclosure;
  (2) one or more oxidant gas injectors mounted in the enclosure and adapted to introduce oxygen-containing gas into the furnace;
  (3) one or more fuel lances mounted in the enclosure and spaced apart from the one or more oxidant gas injectors, wherein the one or more fuel lances are adapted to inject fuel into the furnace; and
  (4) one or more igniters associated with the one or more fuel lances and adapted to ignite the fuel injected by the fuel lances;
(b) injecting the oxygen-containing gas through the one or more oxidant gas injectors into the combustion atmosphere in the furnace;
(c) injecting the fuel through the one or more fuel lances into the combustion atmosphere in the furnace; and
(d) operating the one or more igniters and igniting the fuel from the fuel lances to cause combustion of the fuel with oxygen in the combustion atmosphere.

BRIEF DESCRIPTION OF SEVERAL VIEWS OF THE DRAWINGS

FIG. 7A is a schematic sectional view of an exemplary igniter used in an embodiment of the invention.

FIG. 7B is a front view of FIG. 7A.

FIG. 8A is a schematic sectional view of an alternative exemplary igniter pilot used in an embodiment of the invention.

FIG. 8B is a front view of FIG. 8A.

DETAILED DESCRIPTION OF THE INVENTION

Figure 1:
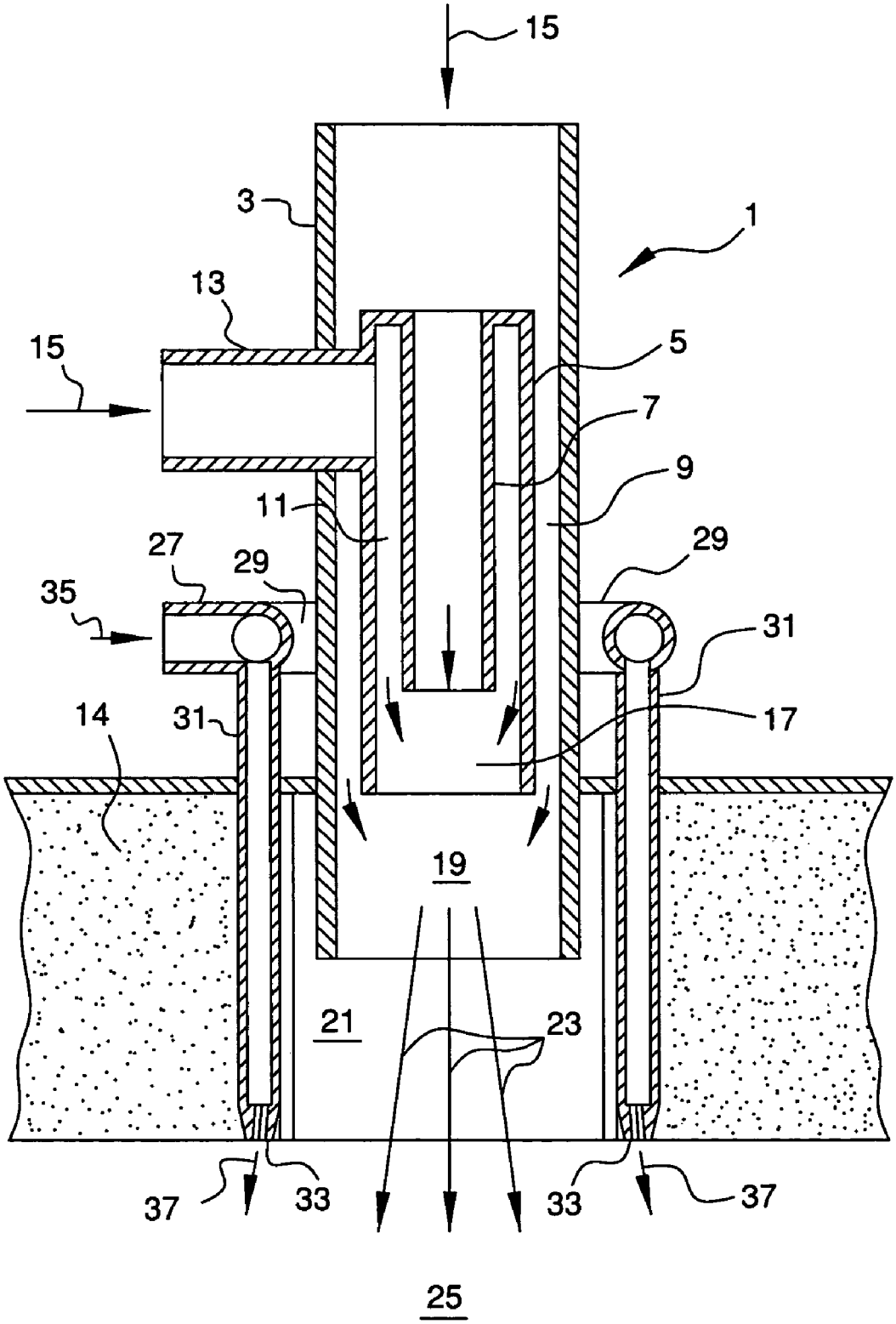
FIG. 1 is a schematic sectional view of a burner assembly utilizing secondary fuel injection nozzles.

Combustion-based processes utilize the combustion of fuel streams with oxygen to generate process heat and, in some cases, to consume combustible off-gas streams from other process systems. In the establishment of a combustion reaction with these various fuels, autoignition will occur if the temperature of the fuel-oxidant mixture is above the autoignition temperature of the mixture. In air/natural gas mixtures, for example, the autoignition temperature is about 1,000° F. An ignition source is required to initiate the combustion reaction if the temperature of the fuel-oxidant mixture is below its autoignition temperature.

An additional variable, the extent of mixing in the combustion atmosphere or combustion region, can affect the stability of the combustion process with a gaseous or vaporized fuel. Stabilization of the combustion process becomes complicated when fuel staging is used to limit formation of $NO_x$. In fuel staging, raw fuel (without air or oxygen) is introduced into the combustion atmosphere containing excess oxygen remaining from an earlier step of combustion. Although the fuel for each stage of combustion typically is identical, different fuel sources may be used, and the use of different staging fuels may affect the operating stability of the combustion process. In order to minimize formation of $NO_x$, it is desirable to introduce the staging fuel into the combustion atmosphere at or near a location having a minimum concentration of oxygen.

The maintenance of flame stability and flame location in staged fuel combustion systems may be difficult during unsteady-state process conditions that occur in a furnace during cold startup, process upsets, or turndown conditions. During such conditions, localized temperatures may fall below the autoignition temperature of the fuel-oxidant mixture and may result in unstable flames and/or regions containing unburned fuel. This is undesirable and may lead to the possibility of an uncontrolled energy release in the furnace.

Flame stability, which is the proper location of the flame front relative to the point of introduction of the fuel stream in the combustion atmosphere, is a key aspect of the successful application of fuel staging. In conventional staged combustion systems, flame stability is maintained by the use of combinations of fuel injection devices and mixing patterns to improve the contact between the fuel-rich jet and the source of oxygen, which could be the inlet combustion air stream or unreacted oxygen contained in the gaseous atmosphere in the furnace. The proper location and amount of ignition energy also is important. Designs for fuel injection devices typically attempt to anchor the flame at the flame holder tip, which can be the fuel injector itself, a separate bluff body device (such as an external surface of refractory tile), or a swirl stabilizer nozzle. The drawback of conventional bluff body type flame stabilizers is that they have a limited turndown ratio, which limits their stability performance during cold start-up and process upset conditions. Any substantial distance or lift-off height between the staged fuel jet flame front and the flame holder surface will cause oscillation in the flame and result in undesirable combustion performance, including increased $NO_x$ emissions and/or the presence of unburned fuel.

When non-steady state conditions such as start-up or process upsets occur while flow through the conventional fuel staging system is maintained, the volume of fuel that exists at high concentrations can increase substantially within the combustion system. The regions near the fuel-rich jets from the injection devices may be outside of the flammability limits (e.g., between 5 and 15 vol % for natural gas) and there may be insufficient ignition energy available in the cold furnace. When multiple elements of these fuel staging systems are included in one piece of equipment or when the flame is re-established from a single burner, additional sources of ignition may be present in the furnace. These ignition sources may be, for example, radicals formed in the combustion reactions at the burner and/or the staged fuel injection devices. An uncontrolled energy release promoted by the reaction of these radicals with the volume of unburned fuel in a process heater, boiler, reformer, or other similar unit operation is a safety and operability concern.

Conventional burner technology cannot provide flame stability for individual fuel staging lances during cold start-up, at low furnace temperatures, and during upset or turndown conditions. Lack of stability during these periods could lead to flame lift-off and subsequent uncontrolled energy release as discussed above. A robust solution is needed to address these potentially unsafe conditions. The preferred solution should utilize changes and enhancements to the combustion equipment itself rather than require the execution of specific operating and control steps by process operating personnel. Such a solution is disclosed in embodiments of the present invention wherein one or more ignition sources are used in conjunction with the fuel injection lances that introduce staging fuel into a combustion region or zone.

Ignition-assisted fuel lances are used in various embodiments of this invention in order to ensure ignition of the fuel injected into oxygen-containing gases in a combustion atmosphere in a process heater, furnace, steam boiler, gas turbine combustor, or other gas-fired combustion system. A fuel lance is defined herein as a device for injecting fuel at an elevated velocity into a combustion atmosphere. The combustion atmosphere contains an oxidant gas, and the staging fuel injected into the oxidant gas is combusted with oxygen in the oxidant gas. The oxidant gas may be air, oxygen-enriched air, or a combustion gas containing combustion products and unreacted oxygen. For example, ignition-assisted fuel lances may be installed in a furnace boundary, wall, or enclosure adjacent to but separate from a burner wherein the fuel lances inject fuel into the combustion atmosphere generated by the burner to effect concentrically-staged combustion. Alternatively, ignition-assisted fuel lances may be installed adjacent to but separate from a source of oxidant gas such as air, wherein the fuel lances inject portions of the fuel into the oxidant gas or the combustion atmosphere to effect matrix-staged combustion.

The term "combustion atmosphere" as used herein means the atmosphere within the enclosure or boundaries of a furnace. The overall combustion atmosphere within the boundaries of the furnace comprises oxygen, fuel, combustion gas containing combustion reaction products (e.g., carbon oxides, nitrogen oxides, and water), and inert gases (e.g., nitrogen and argon). The source of the oxygen and inert gases typically is air; an alternative or additional source of oxygen may be an oxygen injection system which introduces oxygen-enriched air and/or high purity oxygen to enhance the combustion process. The combustion atmosphere is heterogenous because the concentration of the components varies throughout the furnace. For example, the concentration of oxygen may be higher near oxidant injection points and the concentration of fuel may be higher near the fuel injection points. In other regions of the combustion atmosphere, there may be no fuel present. The concentration of oxygen and combustion reaction products will vary depending on the extent of combustion at various locations within the combustion atmosphere. At certain locations, injected fuel may react directly with oxygen in the oxidant gas injected into the combustion atmosphere; at other locations, injected fuel may react with unreacted oxygen from combustion occurring elsewhere in the combustion atmosphere.

A thermal load is disposed in the combustion atmosphere within the interior of the furnace, wherein a thermal load is defined as (1) the heat absorbed by material transported through the furnace combustion atmosphere wherein the heat is transferred from the combustion atmosphere to the material as it is transported through the furnace or (2) the heat exchange apparatus adapted to transfer heat from the combustion atmosphere to the material being heated.

An example of a concentrically-staged combustion burner system is illustrated in sectional view in FIG. 1, which shows a central burner or flame holder surrounded by multiple injection lances for injecting staging fuel. A burner is defined as an integrated combustion assembly for the combustion of oxidant and fuel, wherein the burner is adapted for mounting in the wall or enclosure of a furnace. Central burner or flame holder 1 comprises outer pipe 3, concentric intermediate pipe 5, and inner concentric pipe 7. The interior of inner pipe 7 and annular space 9 between outer pipe 3 and intermediate pipe 5 are in flow communication with the interior of outer pipe 3. Annular space 11 between inner pipe 7 and intermediate pipe 5 is connected to and in flow communication with fuel inlet pipe 13. The central burner is installed in furnace wall 14.

In the operation of this central burner, oxidant gas (typically air or oxygen-enriched air) 15 flows into the interior of outer pipe 3, a portion of this air flows through the interior of inner pipe 7, and the remaining portion of this air flows through annular space 9. Primary fuel 15 flows through pipe 13 and through annular space 11, and is combusted initially in combustion zone 17 with air from inner pipe 7. Combustion gas from combustion zone 17 mixes with additional air in combustion zone 19. Combustion in this zone is typically extremely fuel-lean. A visible flame typically is formed in combustion zone 19 and in combustion zone 21 as combustion gas 23 enters furnace interior 25. The term "combustion zone" as used here means a region within the burner in which combustion occurs.

A staging fuel system comprises inlet pipe 27, manifold 29, and a plurality of staging fuel lances 31. The ends of the staging fuel lances may be fitted with injection nozzles 33 of any desired type. Staging fuel 35 flows through inlet pipe 27, manifold 29, and staging fuel injection lances 31. Staging fuel streams 37 from nozzles 33 mix rapidly and combust with the oxidant-containing combustion gas 23. The cooler combustion atmosphere in furnace interior 25 is rapidly entrained by staging fuel streams 37 by the intense mixing action promoted by nozzles 33, and the concentrically-injected staging fuel is combusted with the oxidant-containing combustion atmosphere downstream of the exit of central burner 1. The primary fuel may be 5 to 30% of the total fuel flow rate (primary plus staging) and the staging fuel may be 70 to 95% of the total fuel flow rate.

The primary and staging fuels may have the same composition or may have different compositions and either fuel may be any gaseous, vaporized, or atomized hydrocarbon-containing material. For example, the fuel may be selected from the group consisting of natural gas, refinery offgas, associated gas from crude oil production, and combustible process waste gas. An exemplary process waste gas is the tail gas or waste gas from a pressure swing adsorption system in a process for generating hydrogen from natural gas.

Figure 2:
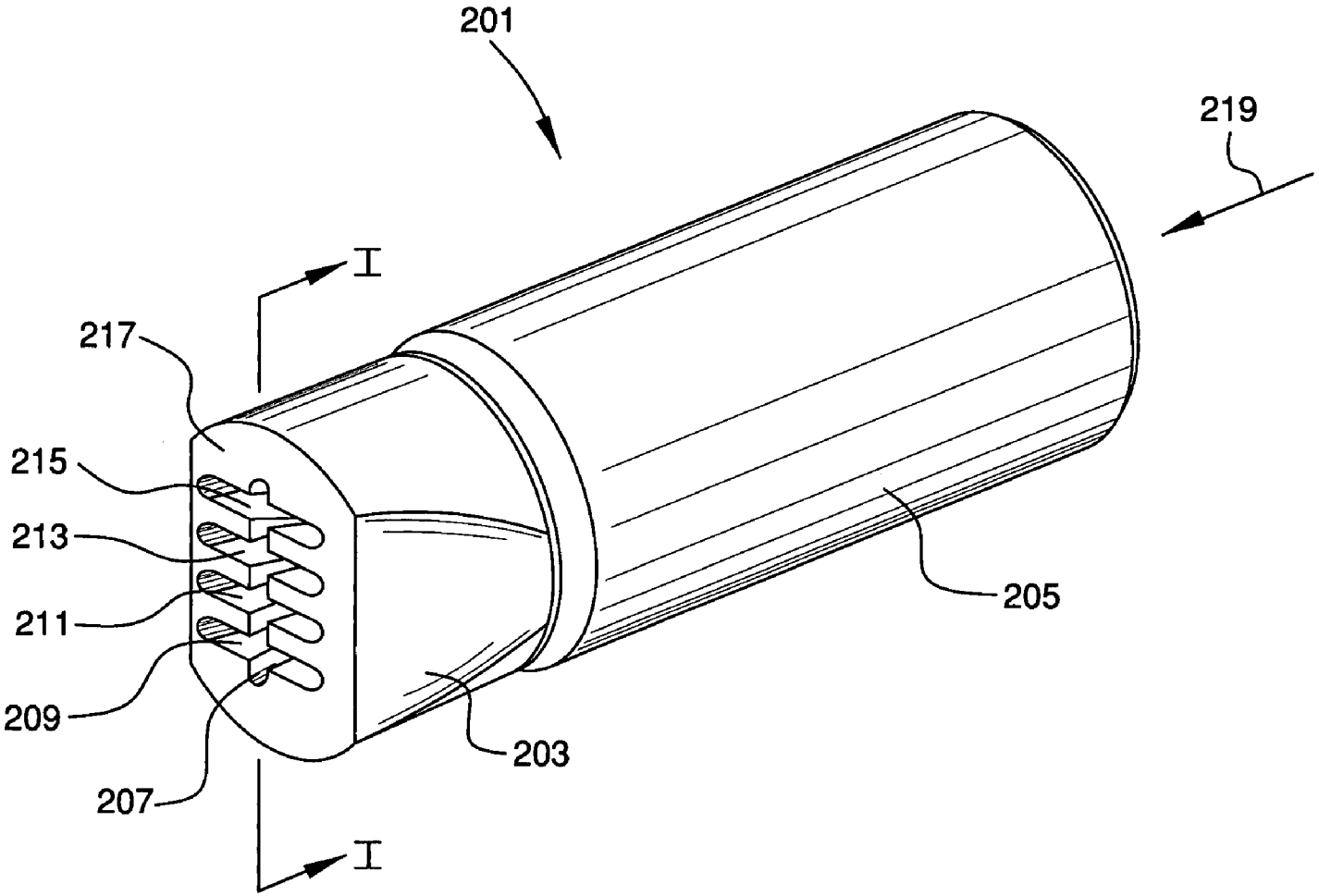
FIG. 2 is an isometric view of a nozzle assembly and nozzle body that may be used in an embodiment of the present invention.

An exemplary type of nozzle 33 is illustrated in FIG. 2. Nozzle assembly 201 comprises nozzle body 203 joined to nozzle inlet pipe 205. Slot 207, illustrated here as vertically-oriented, is intersected by slots 209, 211, 213, and 215. The slots are disposed between outlet face 217 and an inlet face (not seen) at the connection between nozzle body 203 and nozzle inlet pipe 205. Fluid 219 flows through nozzle inlet pipe 205 and through slots 207, 209, 211, 213, and 215, and then mixes with another fluid surrounding the slot outlets. In addition to the slot pattern shown in FIG. 2, other slot patterns are possible; the nozzle assembly can be used in any orientation and is not limited to the generally horizontal orientation shown. When viewed in a direction perpendicular to outlet face 217, exemplary slots 209, 211, 213, and 215 intersect slot 207 at right angles. Other angles of intersection are possible between exemplary slots 209, 211, 213, and 215 and slot 207. When viewed in a direction perpendicular to outlet face 217, exemplary slots 209, 211, 213, and 215 are parallel to one another; however, other embodiments are possible in which one or more of these slots are not parallel to the remaining slots.

The term "slot" as used herein is defined as an opening through a nozzle body or other solid material wherein any slot cross-section (i.e., a section perpendicular to the inlet flow axis defined below) is non-circular and is characterized by a major axis and a minor axis. The major axis is longer than the minor axis and the two axes are generally perpendicular. For example, the major cross-section axis of any slot in FIG. 2 extends between the two ends of the slot cross-section; the minor cross-section axis is perpendicular to the major axis and extends between the sides of the slot cross-section. The slot may have a cross-section of any non-circular shape and each cross-section may be characterized by a center point or centroid, where centroid has the usual geometric definition.

A slot may be further characterized by a slot axis defined as a straight line connecting the centroids of all slot cross-sections. In addition, a slot may be characterized or defined by a center plane which intersects the major cross-section axes of all slot cross-sections. Each slot cross-section may have perpendicular symmetry on either side of this center plane. The center plane extends beyond either end of the slot and may be used to define the slot orientation relative to the nozzle body inlet flow axis as described below.

Figure 3:
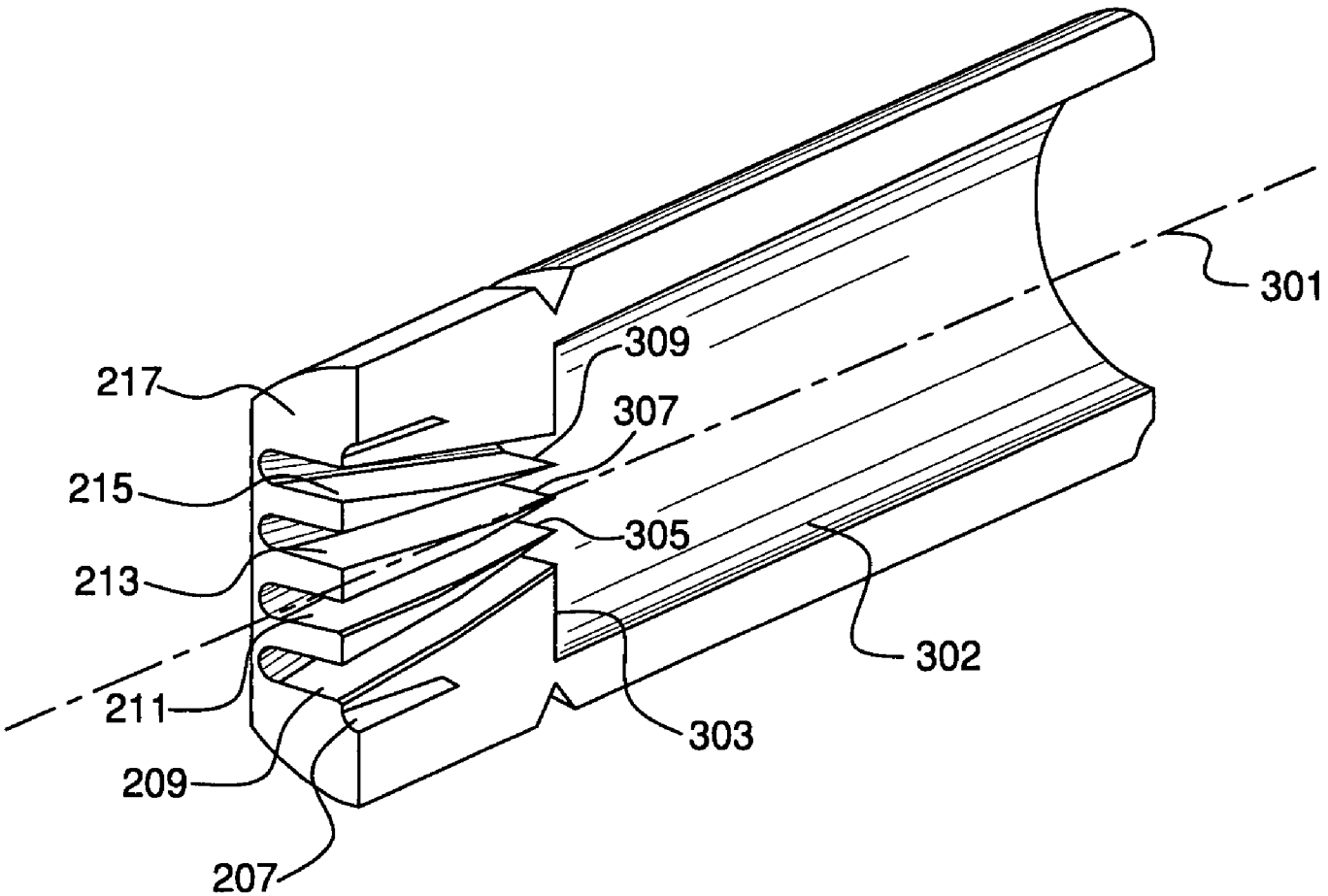
FIG. 3 an axial section drawing of the nozzle body of FIG. 2.

Axial section I-I of the nozzle of FIG. 2 is given in FIG. 3. Inlet flow axis 301 passes through the center of nozzle inlet pipe 302, inlet face 303, and outlet face 217. In this embodiment, the center planes of slots 209, 211, 213, and 215 lie at angles to inlet flow axis 301 (i.e., are not parallel to inlet flow axis 301) such that fluid flows from the slots at outlet face 217 in diverging directions from inlet flow axis 301. The center plane of slot 207 (only a portion of this slot is seen in FIG. 3) also lies at an angle to inlet flow axis 301. This exemplary feature directs fluid from the nozzle outlet face in another diverging direction from inlet flow axis 301. In this exemplary embodiment, when viewed in a direction perpendicular to the axial section of FIG. 3, slots 209 and 211 intersect at inlet face 303 to form sharp edge 305, slots 211 and 213 intersect to form sharp edge 307, and slots 213 and 215 intersect to from sharp edge 309. These sharp edges provide aerodynamic flow separation to the slots and reduce pressure drop associated with bluff bodies. Alternatively, these slots may intersect at an axial location between inlet face 303 and outlet face 217, and the sharp edges would be formed within nozzle body 203. Alternatively, these slots may not intersect when viewed in a direction perpendicular to the axial section of FIG. 2, and no sharp edges would be formed.

The term "inlet flow axis" as used herein is an axis defined by the flow direction of fluid entering the nozzle at the inlet face, wherein this axis passes through the inlet and outlet faces. Typically, but not in all cases, the inlet flow axis is perpendicular to the center of nozzle inlet face 303 and/or outlet nozzle face 217, and meets the faces perpendicularly. When nozzle inlet pipe 302 is a typical cylindrical conduit as shown, the inlet flow axis may be parallel to or coincident with the conduit axis.

The axial slot length is defined as the length of a slot between the nozzle inlet face and outlet face, for example, between inlet face 303 and outlet face 217 of FIG. 3. The slot height is defined as the perpendicular distance between the slot walls at the minor cross-section axis. The ratio of the axial slot length to the slot height may be between about 1 and about 20.

The multiple slots in a nozzle body may intersect in a plane perpendicular to the inlet flow axis. As shown in FIG. 2, for example, slots 209, 211, 213, and 215 intersect slot 207 at right angles. If desired, these slots may intersect in a plane perpendicular to the inlet flow axis at angles other than right angles. Adjacent slots also may intersect when viewed in a plane parallel to the inlet flow axis, i.e., the section plane of FIG. 3. As shown in FIG. 3, for example, slots 209 and 211 intersect at inlet face 303 to form sharp edge 305 as earlier described. The angular relationships among the center planes of the slots, and also between the center plane of each slot and the inlet flow axis, may be varied as desired. This allows fluid to be discharged from the nozzle in any selected direction relative to the nozzle axis.

Alternative, a nozzle body may be envisioned in which none of the slots intersect each other in any plane perpendicular to axis 301. In this alternative embodiment, for example, all slots viewed perpendicular to the nozzle body face are separate and do not intersect other slots. Such a nozzle could, for example, be similar to the nozzle of FIG. 2 without slot 207, wherein the nozzle would have only slots 209, 211, 213, and 215. These slots may intersect axially as shown in FIG. 2.

Figure 4:
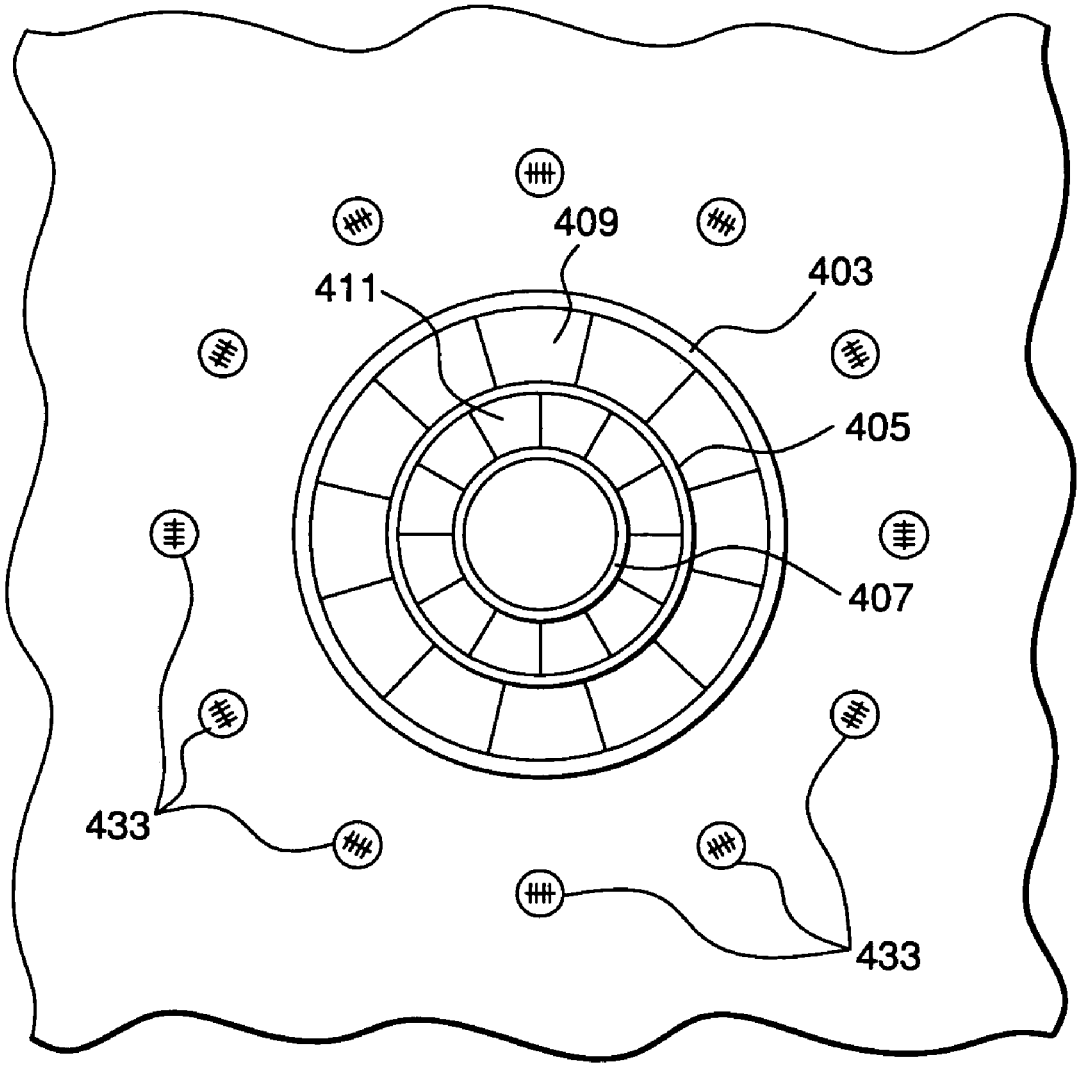
FIG. 4 is a schematic front view of the burner assembly of FIG. 1.

FIG. 4 is a plan view showing the discharge end of the exemplary apparatus of FIG. 1 utilizing the staging fuel lance nozzles of FIGS. 2 and 3. Concentric pipes 403, 405, and 407 enclose annular spaces 409 and 411 which are fitted with radial members or fins. Slotted staging fuel injection nozzles 433 (earlier described) may be disposed concentrically around the central burner as shown. In this embodiment, the slot angles of the slotted injection nozzles are oriented to direct injected staging fuel in diverging directions relative to the axis of central burner 1.

Other types of nozzle configurations may be used for nozzle body 203 (FIG. 2) at the injection ends of staging fuel nozzles 433 (FIG. 4). For example, the openings in outlet face 217 of nozzle body 203 may be formed in the shape of one or more cross-shaped openings formed by two intersecting slots. Alternatively, any other types of openings may be used in the nozzle body face which have shapes different from the slots described above.

Figure 5:
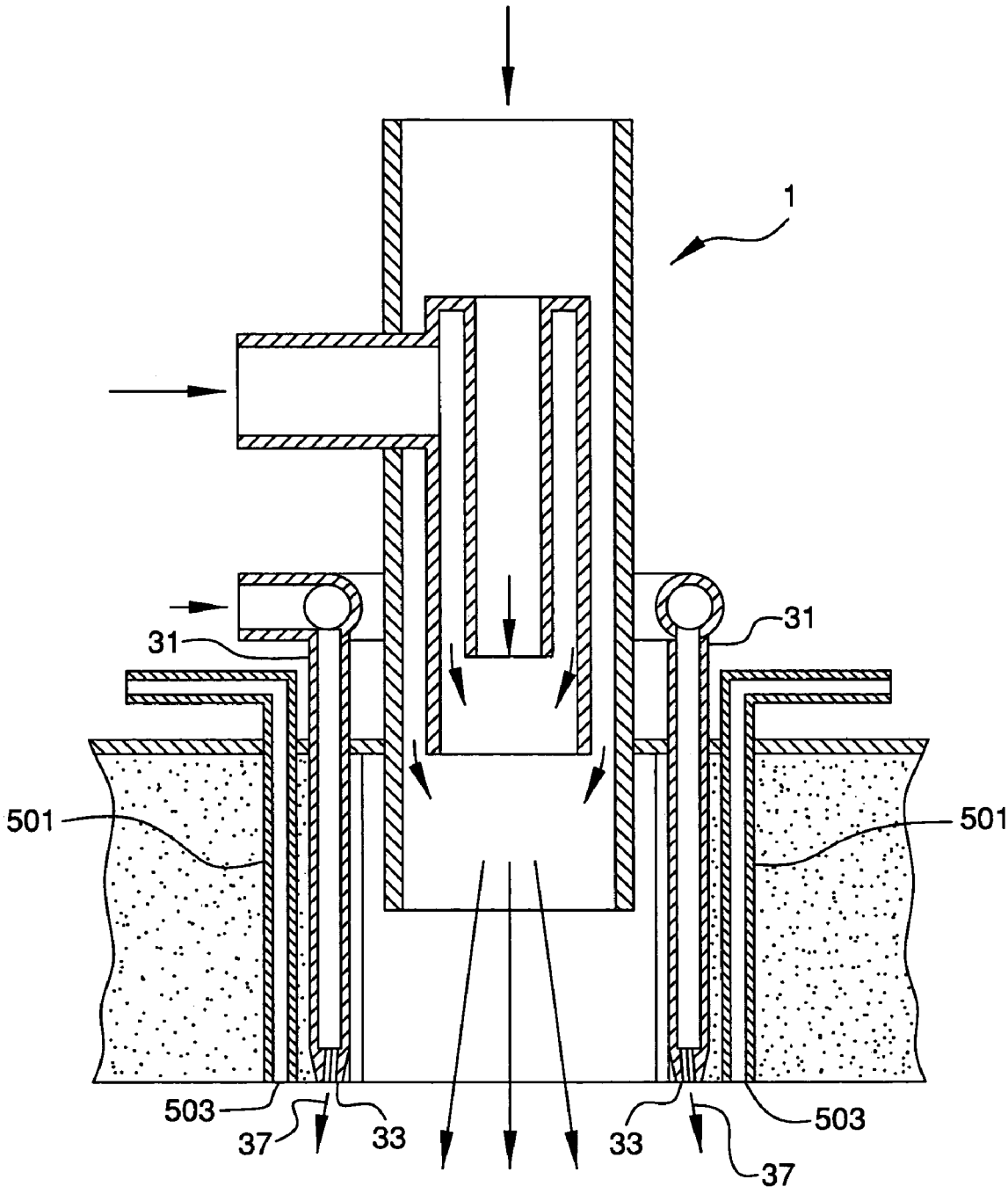
FIG. 5 is a schematic sectional view of a burner assembly utilizing secondary fuel injection nozzles and exemplary igniters relating to embodiments of the invention.

The exemplary concentrically-staged combustion burner system of FIG. 1 may be modified according to an embodiment of the invention as illustrated in FIG. 5. Igniters 501, shown here schematically, are associated with staging fuel lances 31 and are adapted to ignite staging fuel 37 discharged from nozzles 33. The igniters may be adjacent the staging fuel lances as shown, wherein the ignition ends 503 of the igniters are adjacent the tips of nozzles 33. Alternatively, the igniters may be integrated into the staging fuel lances as described later. The generic meaning of the term "igniter" as used herein is a device to generate a localized temperature above the autoignition temperature of the fuel-oxidant mixture. For example, igniters 501 adjacent to nozzles 33, thereby ensuring ignition of the staging fuel stream. Igniters 501 are shown schematically in FIG. 5 and may be any type of igniter capable of generating temperatures sufficiently high to ignite the mixture of staging fuel and oxidant. For example, these igniters may generate pilot flames at ignition ends 503 wherein the pilot flames are formed by combusting a fuel-oxidant mixture separate from the fuel-oxidant mixture of the central burner. Alternatively, igniters 501 may be intermittent spark igniters, continuous spark igniters, DC arc plasmas, microwave plasmas, RF plasmas, high energy laser beams, or any other type of igniter at ignition ends 503.

Figure 6:
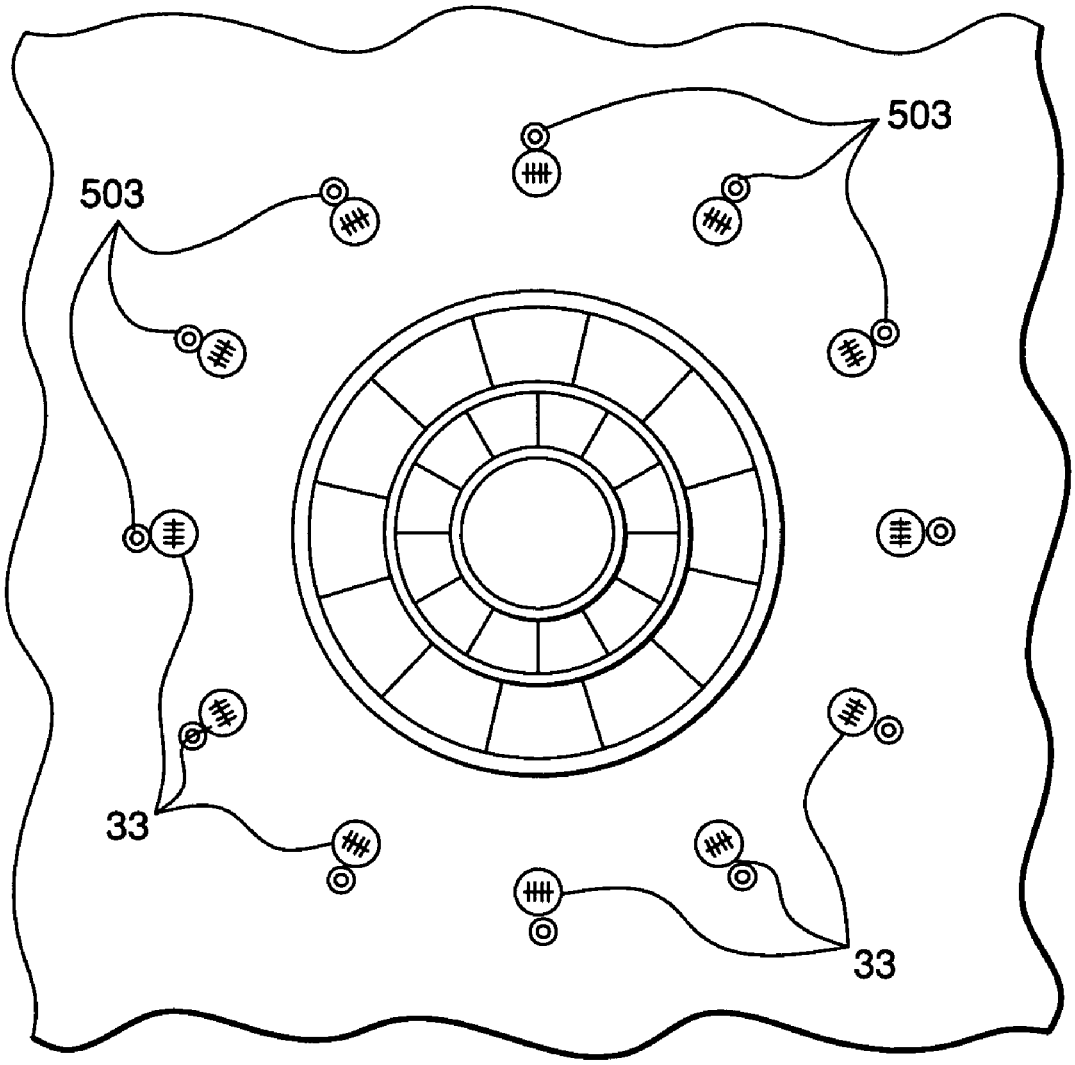
FIG. 6 is a schematic front view of the burner assembly of FIG. 5.

The location of the igniters in FIG. 5 may be seen in the plan view of FIG. 6 showing the discharge end of the central burner and schematic ignition ends 503 associated with concentric injection nozzles 33. In this embodiment, each ignition end is adjacent a staging injection nozzle. Alternatively, the igniters may be integrated into staging fuel lances 31 as described later. In the embodiment of FIG. 6, each injection nozzle and fuel lance has an adjacent igniter, and the number of igniters and the number of staging fuel lances are equal. Alternatively, the number of staging fuel lances may be less than the number of igniters, wherein each igniter effects the ignition of a plurality of fuel lances. In one example, igniters may be associated with alternating staging fuel lances wherein the number of igniters is half the number of fuel lances. Any number and configuration of igniters may be used to effect proper ignition of the staging fuel-oxidant mixture. In the present disclosure, the term "associated with" means that an igniter associated with a staging fuel lance is adapted for and is capable of igniting the fuel-oxidant mixture formed by the staging fuel from the staging fuel lance and the oxidant present in the region adjacent the discharge of the lance. As mentioned above, an igniter associated with a lance may be adjacent the lance or may be an integral part of the lance.

Igniter 501 (FIG. 5) may utilize a pilot flame formed at ignition end 503 by a pilot fuel and a pilot oxidant. The pilot fuel may be the same fuel as that provided to the staging fuel lance, or may be a different fuel such as, for example, the primary fuel 15 of central burner 1. The pilot oxidant may be air, oxygen-enriched air, or other oxygen-containing gas. The direction of the pilot flame discharge may be generally parallel to the direction of the staging fuel discharge, or alternatively may be at any angle to the direction of the staging fuel discharge. In one embodiment, the pilot flame may be directed radially outward from the axis of the central burner and in another embodiment may be directed generally parallel to the axis of the central burner. The pilot fuel and pilot oxidant may be premixed upstream of the end of the igniter or alternatively the fuel and oxidant may be delivered to and combusted near the ignition end of the pilot-type igniter. The igniter itself may be equipped with spark ignition means to ignite the pilot fuel and pilot oxidant as described below.

An exemplary igniter is a pilot device shown in FIGS. 7A (side sectional view) and 7B (end view). This pilot comprises outer pipe 701, inner pipe 703, flow turbulence generator or bluff body 705, and annulus 707. An oxidant gas such as air or oxygen-enriched air flows through annulus 707 and over flow turbulence generator or bluff body 705, and fuel gas flows through inner pipe 703. The fuel and oxidant combust to form a pilot flame at the outlet of the pilot. If desired, an electrical ignition device may be used for initial ignition of the pilot fuel and oxidant. An exemplary ignition device is shown in FIGS. 8A and 8B, wherein electrode 801 is installed in the interior of inner pipe 703. The end of the electrode typically extends beyond the end of inner pipe 703 and is disposed in the region between the ends of inner pipe 703 and outer pipe 701. A spark is generated between the end of the electrode and the inner wall of outer pipe 701 when the electrode is electrically energized. Oxidant and fuel flow through inner pipe 703 and annulus 707, respectively, mix in the region between the ends of inner pipe 703 and outer pipe 701, and are ignited by a spark generated between the end of the electrode and the inner wall of outer pipe 701.

An alternative type of igniter pilot may be used as an alternative to FIGS. 8A and 8B. In this alternative, inner pipe 703 is not used, and a pre-mixed fuel-oxidant mixture is provided through pipe 701 and ignited by a spark from the end of electrode 801.

The pilot igniters described above may be operated continuously, for example, during operation of a furnace fired by a plurality of burners, for example, as in burner 1 of FIG. 5). Alternatively, the pilot igniters may be operated only during cold startup of the furnace and would be inactive during normal operation of the furnace.

Figure 9:
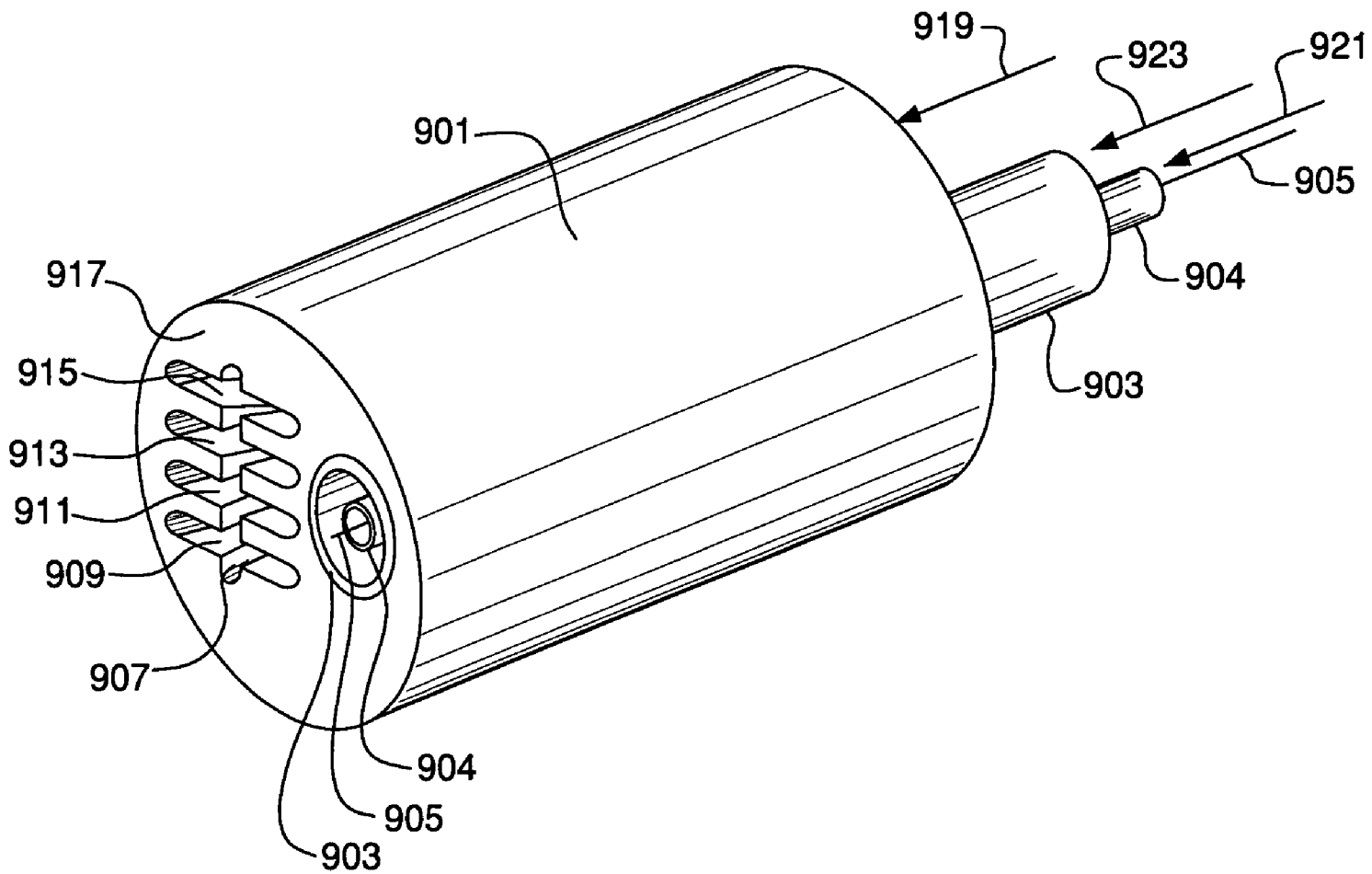
FIG. 9 is an isometric view of an integrated fuel injector nozzle and igniter according to an embodiment of the invention.

A pilot igniter of FIGS. 7A and 7B or FIGS. 8A and 8B may be installed adjacent each staging fuel lance as shown in FIGS. 5 and 6. Alternatively, the pilot igniter may be designed as an integral part of a staging fuel lance as illustrated in FIG. 9. In this exemplary embodiment, the electrode-assisted pilot igniter of FIGS. 8A and 8B is integrated into the fuel lance and nozzle of FIGS. 2 and 3. In the integrated fuel lance and igniter assembly 901 of FIG. 9, slots 909, 911, 913, and 915 intersect slot 907 as shown, and all slots pass through fuel lance nozzle face 917 and lie at angles to the inlet flow axis of the lance such that fluid flows from the slots at outlet face 917 in diverging directions from inlet flow axis. The igniter comprises outer pipe 903, inner pipe 904, and electrode 905, and these components are installed in a bore through the lance parallel to the axis of the lance. The igniter operates as described above with reference to FIGS. 8A and 8B.

Fuel 919 enters the lance inlet end, flows through an interior fuel passage (not seen), and exits slots 907, 909, 911, 913, and 915 at nozzle face 917. Pilot fuel 921, which may be the same or different than lance fuel 919, flows into and through inner pipe 904. Pilot oxidant gas 923, (for example, air or oxygen-enriched air) flows into and through the annulus between outer pipe 903 and inner pipe 904. Ignition electrode 905 is used to ignite the mixture of pilot fuel and oxidant gas as described above.

Instead of the pilot flame igniter discussed above as part of the ignition-assisted lance of FIG. 9, any other type of igniter may be used. The igniter may be selected from, for example, intermittent spark igniters, continuous spark igniters, DC arc plasmas, microwave plasmas, RF plasmas, and high energy laser beams.

An alternative embodiment of the invention relates to a combustion system having oxidant injectors for injecting oxidant gas into a furnace and separate ignition-assisted fuel lances for injecting fuel into the furnace. No individual burners are used in this embodiment, which may be considered a matrix combustion system. The system comprises a furnace having an enclosure and a thermal load disposed within the enclosure; one or more oxidant gas injectors mounted in the enclosure and adapted to introduce an oxygen-containing gas into the furnace; one or more fuel lances mounted in the enclosure and spaced apart from the one or more oxidant gas injectors, wherein the one or more fuel lances are adapted to inject fuel into the furnace; and one or more igniters associated with the one or more fuel lances and adapted to ignite the fuel injected by the fuel lances. When one or more oxidant gas injectors and a plurality of fuel lances are used, the combustion system may be defined as a matrix-staged combustion system.

Figure 10:
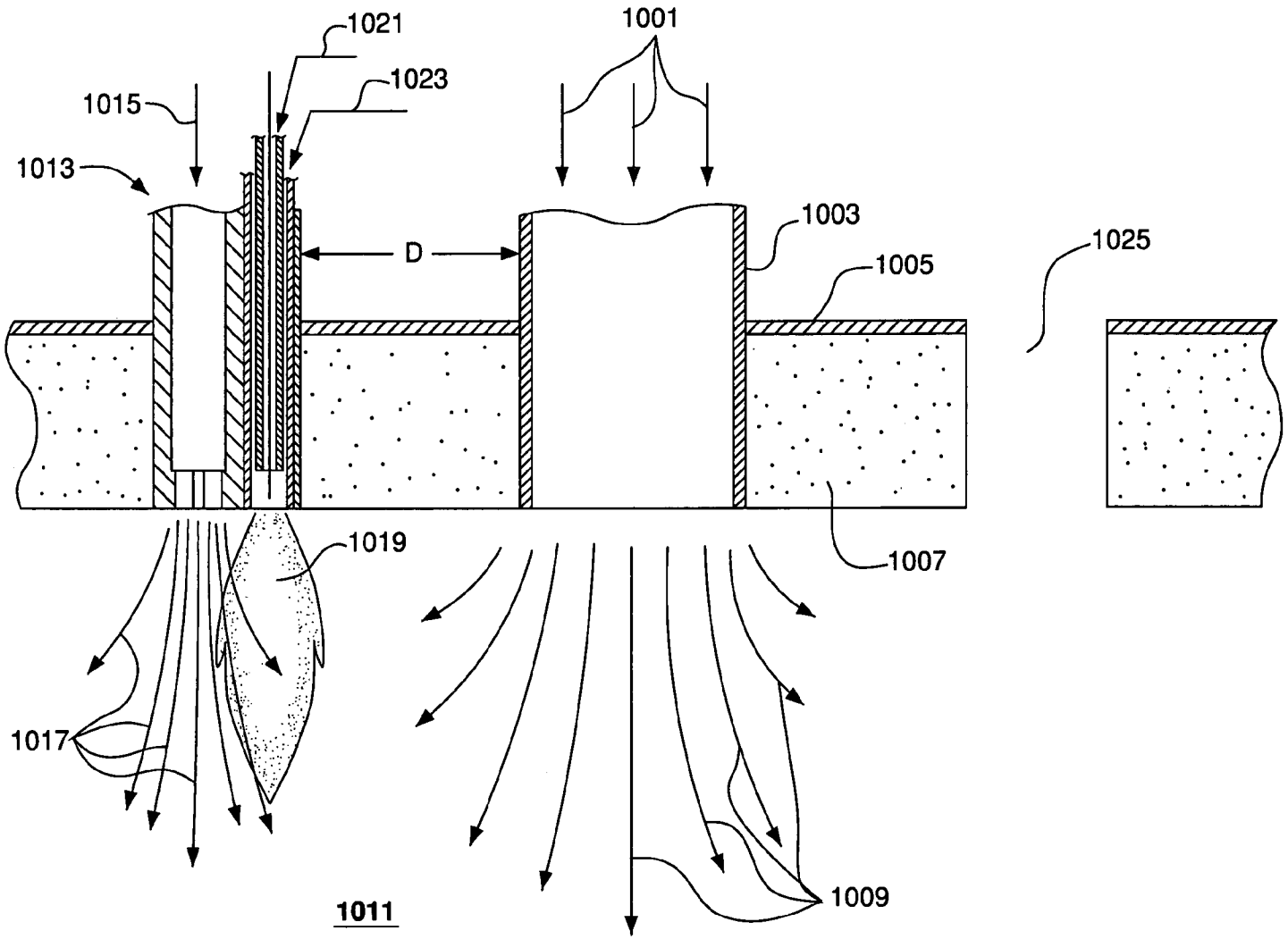
FIG. 10 is a schematic sectional view of another embodiment of the invention in which the integrated fuel injector nozzle and igniter of FIG. 9 and an oxidant gas injector are installed in the wall or enclosure of a furnace.

This embodiment is illustrated schematically in FIG. 10 wherein oxidant gas 1001 is injected through oxidant gas injector 1003 mounted in furnace wall or enclosure 1005. The furnace wall or enclosure may be lined with high-temperature refractory 1007 as shown. Oxidant gas 1001 may be air, oxygen-enriched air, or any other oxygen-containing gas. Injected oxidant gas forms distributed jet 1009 within the combustion atmosphere in the interior 1011 of the furnace.

Ignition-assisted fuel lance 1013 is disposed in furnace wall 1005 apart from oxidant gas injector 1003 and operates to inject fuel gas 1015 into furnace interior 1011 and form distributed fuel gas jet 1017. Ignition-assisted fuel lance 1013 is shown here as a sectional view of the lance described above with reference to FIG. 10, although any type of ignition-assisted lance may be used. The distance D between the periphery of oxidant gas injector 1003 and the periphery of adjacent ignition-assisted fuel lance 1013 may be in the range of 2 to 50 inches. Pilot flame 1019 is formed by the combustion of an oxidant-fuel mixture provided by pilot fuel 1021 and pilot oxidant 1023 ignited by the electrode disposed within the lance as earlier described.

Pilot flame 1019 ignites the fuel-oxidant mixture formed by fuel 1017 and oxidant 1009 in combustion atmosphere 1011 in the furnace interior if the temperature of the fuel-oxidant mixture is below its autoignition temperature. Typically a flame (not shown) is formed immediately downstream of distributed fuel gas jet 1017. If the temperature of the fuel-oxidant mixture is above its autoignition temperature, operation of the pilot flame igniter may not be needed; however, operation of the pilot flame may be continued to provide ignition of the fuel-oxidant mixture if needed in the event of an operating upset in the furnace operation.

Additional ignition-assisted fuel lances may be disposed at other spaced-apart locations in furnace wall 1005; for example, a lance identical to lance 1013 may be installed in opening 1025 shown on the opposite side of oxidant gas injector 1003. In the embodiment of FIG. 10, oxidant gas injector 1003 and ignition-assisted fuel lance 1013 (and any other ignition-assisted fuel lances not shown) typically are separate elements installed in furnace wall 1005. One or more oxidant gas injectors and a plurality of fuel lances may be used to provide a matrix-staged combustion system.

Figure 11:
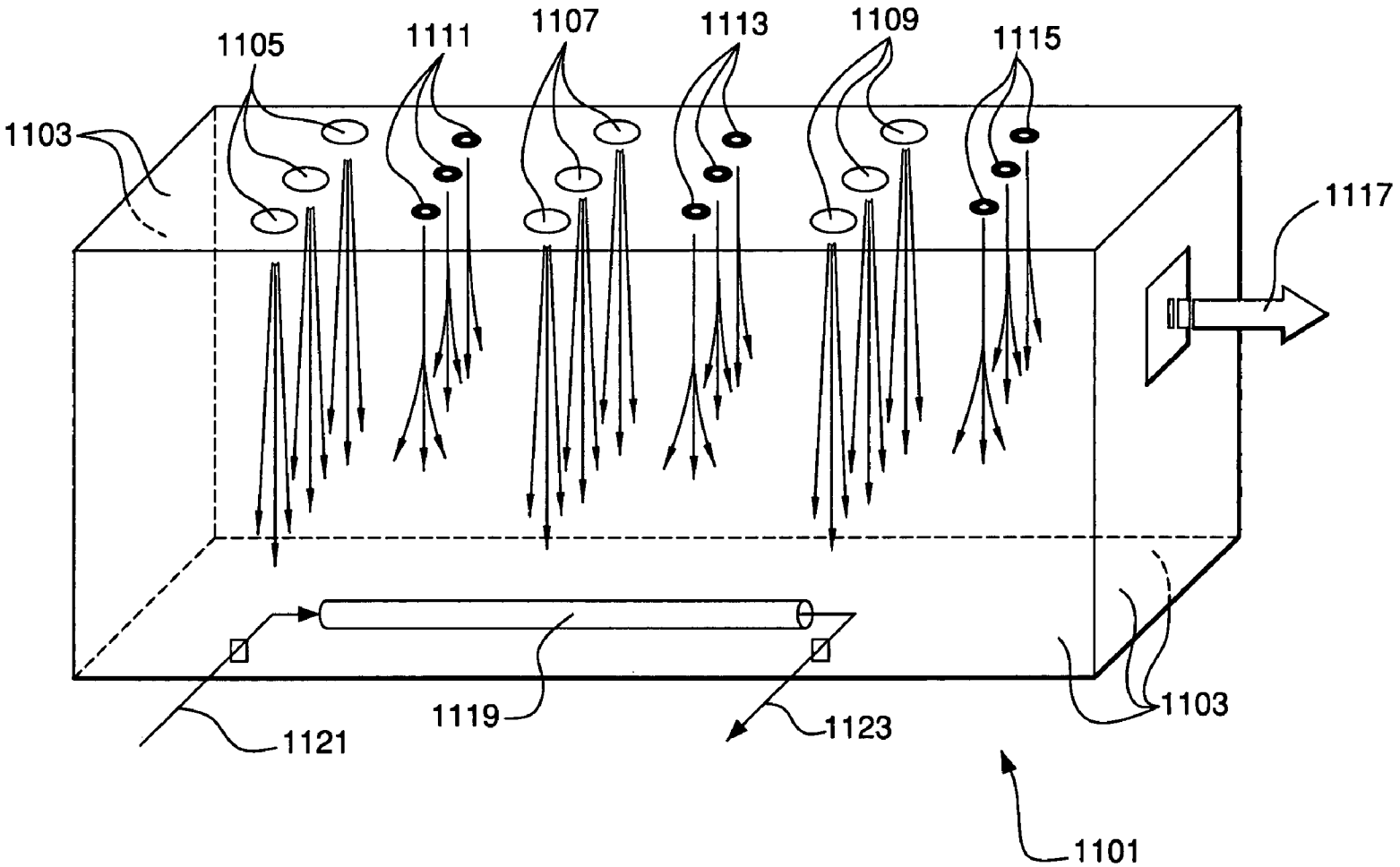
FIG. 11 is a schematic view of a matrix furnace combustion system in an embodiment using multiple integrated fuel injector nozzles and igniters of FIG. 10 and multiple oxidant gas injectors of FIG. 10.

An exemplary matrix-staged installation utilizing multiple oxidant gas injectors and ignition-assisted fuel lances is illustrated in the embodiment of FIG. 11. An exemplary furnace 1101 is defined by walls or enclosure 1103 to form a right parallelepiped combustion space or volume enclosing a combustion atmosphere, although in other embodiments the combustion atmosphere may be enclosed by any furnace shape. A plurality of oxidant gas injectors 1105, 1107, and 1109 and a plurality of ignition-assisted fuel lances 1111, 1113, and 1115 are installed in the upper boundary or ceiling of the furnace. Each of the oxidant gas injectors introduce jets or streams of oxidant gas into the furnace and each of ignition-assisted fuel lances introduces jets or streams of fuel gas, as illustrated by the downward arrows from each of the injectors and lances. The oxidant gas injectors may be identical to oxidant gas injector 1003 of FIG. 10 and the ignition-assisted fuel lances may be identical to ignition assisted fuel lance 1013 of FIG. 10. Other types of oxidant gas injectors and ignition-assisted fuel lances may be used as desired, and any geometrical arrangement of oxidant gas injectors and ignition-assisted fuel lances may be used.

The injected fuel gas is combusted with the oxidant gas, and combustion may be initiated by the pilot flames in the ignition-assisted lances as earlier described with reference to FIG. 10. Flames typically are formed below the downward-directed fuel jets, and these flames may or may not be visible. The hot combustion atmosphere including carbon oxides, nitrogen oxides, water, unconsumed oxygen, and inert gases exit furnace 1101 as flue gas 1117. Matrix-staged combustion occurs in the furnace as portions of the fuel are injected in fuel lances along the flow axis of the furnace in the direction of the outlet of flue gas 1117.

A thermal load typically will exist in furnace 1101 to absorb a portion of the combustion heat generated therein. In this illustration, schematic heat exchanger 1119 is shown in the bottom of the furnace to heat process feed stream 1121 and convert it to process effluent stream 1123 exiting the furnace. Process feed stream 1121 may be heated in the furnace with or without accompanying chemical reaction. Phase change in the process stream may or may not occur, depending on the particular application. Instead of a process stream comprising the thermal load, articles may be conveyed through the furnace and absorb heat therein, for example, in a metallurgical heat treating process. Regardless of the type of material passing through the furnace, the system and process are characterized by a thermal load which absorbs heat from the hot combustion atmosphere in the furnace. In all embodiments of the invention, the generic meaning of "thermal load" as earlier described is (1) the heat absorbed by material transported through the furnace combustion atmosphere wherein the heat is transferred from the combustion atmosphere to the material as it is transported through the furnace or (2) the heat exchange apparatus adapted to transfer heat from the combustion atmosphere to the material being heated. The combustion atmosphere is contained within the furnace, wherein the furnace is defined as an enclosure within which combustion of injected oxidant and fuel occurs.

While the embodiment of FIG. 11 illustrates a parallelepiped furnace enclosure with top-mounted downward directed injectors, any other desired geometry may be used. For example, the furnace of FIG. 11 may be wall-fired with horizontal oxidant and fuel injection or may be floor-fired with upward oxidant and fuel injection. Alternatively, a cylindrical furnace may be used in which the process tubes are installed in a circular geometry parallel to the cylindrical walls. Fuel and oxidant may be injected at the bottom of the furnace in an upward direction and combustion products may exit at the top of the furnace through a stack. A concentrically-staged combustion system (FIGS. 5 and 6) or a matrix-staged combustion system (FIGS. 10 and 11) may be used in any furnace geometry to yield a uniform heat distribution, better flame stability, and lower $NO_x$ emissions.

The invention claimed is:

1. A combustion process comprising:

(a) providing burner assembly including:

(1) a central flame holder having inlet means for an oxidant gas, inlet means for a primary fuel, a combustion region for combusting the oxidant gas and the primary fuel, and an outlet for discharging a primary effluent from the flame holder; and (2) a plurality of secondary fuel injector nozzles surrounding the outlet of the central flame holder, wherein each secondary fuel injector nozzle comprises:

(2a) a nozzle body having an inlet face, an outlet face, and an inlet flow axis passing through the inlet and outlet faces; and (2b) one or more slots extending through the nozzle body from the inlet face to the outlet face, each slot having a slot axis and a slot center plane;

(3) one or more igniters associated with the plurality of secondary fuel injector nozzles;

(b) introducing the primary fuel and the oxidant gas into the central flame holder, combusting the primary fuel with a portion of the oxidant gas in the combustion region of the flame holder, and discharging a primary effluent containing combustion products and excess oxidant gas from the outlet of the flame holder; and (c) injecting the secondary fuel through the secondary fuel injector nozzles into the primary effluent from the outlet of the flame holder; and (d) operating the one or more igniters and igniting the fuel from the secondary fuel injector nozzles to cause combustion of the fuel with the excess oxidant in the combustion products.

2. The combustion process of claim 1 wherein the primary fuel and the secondary fuel are gases having different compositions.

3. The combustion process of claim 1 wherein the primary fuel is natural gas or refinery offgas and the secondary fuel comprises hydrogen, methane, carbon monoxide, and carbon dioxide obtained from a pressure swing adsorption system.

4. The combustion process of claim 3 wherein the primary fuel and the secondary fuel are gases having the same compositions.

* * * * *